US007448619B2

(12) United States Patent
Kuwata et al.

(10) Patent No.: US 7,448,619 B2
(45) Date of Patent: Nov. 11, 2008

(54) IMAGE PROCESSING APPARATUS

(75) Inventors: Takashi Kuwata, Shizuoka-ken (JP); Masanobu Kanoto, Shizuoka-ken (JP); Yasuyoshi Hayakawa, Shizuoka-ken (JP); Masao Amano, Shizuoka-ken (JP); Kazuhide Kudo, Shizuoka-ken (JP); Masayoshi Fukatsu, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/774,241

(22) Filed: Jul. 6, 2007

(65) Prior Publication Data

US 2008/0014000 A1 Jan. 17, 2008

Related U.S. Application Data

(62) Division of application No. 10/869,941, filed on Jun. 18, 2004, now Pat. No. 7,267,338.

(30) Foreign Application Priority Data

Jun. 20, 2003 (JP) ..... 2003-175983

(51) Int. Cl.
*B65H 31/00* (2006.01)

(52) U.S. Cl. ..... 271/213; 271/207; 271/292; 270/58.08; 399/405

(58) Field of Classification Search ..... 271/213, 271/207, 292; 399/405; 270/58.08
See application file for complete search history.

(56) References Cited

U.S. PATENT DOCUMENTS

| | | | | |
|---|---|---|---|---|
| 5,215,300 | A | 6/1993 | Hiroi et al. | 271/176 |
| 5,708,954 | A | 1/1998 | Ando et al. | 399/402 |
| 5,765,826 | A | 6/1998 | Isoda et al. | 271/162 |
| 6,120,018 | A | 9/2000 | Amano | 271/121 |
| 6,302,389 | B1 * | 10/2001 | Kato et al. | 270/58.13 |
| 6,318,718 | B1 | 11/2001 | Ogata et al. | 271/213 |
| 6,325,371 | B1 | 12/2001 | Araki et al. | 271/297 |
| 6,328,301 | B1 | 12/2001 | Tsujii et al. | 271/117 |
| 6,330,419 | B1 | 12/2001 | Sano et al. | 399/322 |
| 6,338,585 | B1 | 1/2002 | Amano | 400/624 |
| 6,382,614 | B1 | 5/2002 | Fukatsu et al. | 270/58.11 |
| 6,527,267 | B1 | 3/2003 | Kuwata et al. | 271/9.13 |
| 6,561,503 | B1 | 5/2003 | Ogata et al. | 270/58.12 |
| 6,637,996 | B1 | 10/2003 | Hayakawa et al. | 412/9 |
| 6,643,480 | B2 | 11/2003 | Kuwata et al. | 399/107 |
| 6,674,976 | B2 | 1/2004 | Sato et al. | 399/18 |
| 6,733,007 | B2 | 5/2004 | Sekiyama et al. | 271/65 |

(Continued)

FOREIGN PATENT DOCUMENTS

| | | | |
|---|---|---|---|
| JP | 58-152642 | 9/1983 | |
| JP | 61-119562 | 6/1986 | |
| JP | 6-16279 | 1/1994 | |
| JP | 10-129920 | 5/1998 | |
| JP | 10129920 A * | 5/1998 | 271/207 |
| JP | 11-146156 | 5/1999 | |

*Primary Examiner*—Kaitlin S Joerger
(74) *Attorney, Agent, or Firm*—Fitzpatrick, Cella, Harper & Scinto

(57) ABSTRACT

An image processing apparatus ejects the sheet to witch image processing unit perform to an ejection tray or a staple stacker by a pair of ejection rollers and the like. A sheet path for guiding the sheet to the ejection rollers is opened and closed in conjunction with slide movement of the ejection tray when the ejection tray is attached to a main body of the apparatus, and the sheet path is opened and closed in conjunction with the slide movement of a staple stacker when the staple stacker is attached to the main body of the apparatus.

6 Claims, 13 Drawing Sheets

U.S. PATENT DOCUMENTS

| | | | | |
|---|---|---|---|---|
| 6,892,046 | B2 | 5/2005 | Fujita et al. | 399/381 |
| RE39,168 | E | 7/2006 | Hirota et al. | 399/407 |
| 2002/0074708 | A1 | 6/2002 | Nagata et al. | 270/58.08 |
| 2003/0185612 | A1 | 10/2003 | Sekiyama et al. | 399/405 |
| 2004/0022567 | A1 | 2/2004 | Fukatsu et al. | 399/405 |
| 2004/0080739 | A1 | 4/2004 | Sekiyama et al. | 355/407 |

* cited by examiner

IMAGE PROCESSING APPARATUS

This application is a divisional of U.S. patent application Ser. No. 10/869,941, filed on Jun. 18, 2004.

BACKGROUND OF THE INVENTION

1. Field of the Invention

The present invention relates to an image processing apparatus, such as a copying machine, a printer, and a scanner, which performs image processing to a sheet in an image processing unit.

2. Description of the Related Art

FIG. 12 is a principal sectional view of a conventional disk-top type of small copying machine, and FIG. 13 shows an outer appearance of the copying machine.

In FIG. 12, reference numeral 270 designate a main body of an image forming unit, reference numeral 554 designates an image reading unit, reference numeral 551 designates an automatic document feeder (ADF), reference numeral 552 designates a document loading tray, and reference numeral 553 designates a document load glass. In the main body of the image forming unit, it is necessary to change Face Down (FD) ejection in order to response digitalization and continuous ejection page alignment, so that a sheet reverse mechanism is provided near an ejection unit.

In FIG. 12, in order to reverse the sheet which has passed through a fixing device, the sheet reverse mechanism includes an FD/FU switching flapper 501, a pair of reverse feed rollers 502*a* and 502*b*, reverse feed paths 504*a* and 504*b*, an AU feed path 505, a pair of ejection rollers 503*a* and 503*b*, a reverse flapper 506, and an ejection tray 275. The FD/FU flapper 501 properly changes Face Up (FU) and Face Down (FD).

In the above-described configuration, when the document loaded on the document loading tray 552 or the document load glass 553 of the ADF 551 is copied, the copied document is ejected in a face up manner from the pair of ejection rollers 503*a* and 503*b* to a loading tray 505 provided on a side face of the main body 270. In the conventional copying machine, a copying state can be instantly recognized and a height H1 of the document load table of the image reading apparatus shown in FIG. 13 can be lowered, because the ejection unit is provided on not an upper portion but the side face.

In disposing of a paper jam generated in the reverse feed path 504*b*, the reverse feed path 504*b* is opened by integrating the paper ejection tray 505, a sidewall 207*a* of the main body of the image forming apparatus, and a feed guide 502*c* forming the reverse feed path 504*b* to be rotated about a rotation shaft 555 toward a direction of an arrow J. For example, a configuration in which the paper ejection tray and the feed guide forming the feed path are integrated and rotated to open the feed path is disclosed in Japanese Patent Application Laid-Open (JP-A) No. 06-016279.

The configuration in which the paper ejection tray is rotated about an axis in a vertical direction and a guide forming the feed path of the sheet is moved in conjunction with the rotation of the paper ejection tray is disclosed in JP-A No. 11-143156. The configuration in which a sorter is slidably moved is disclosed in Japanese Utility Model Application Laid-Open (JP-U) No. 58-152642.

Sometimes a post-processing device for performing post-processing such as sorting and stapling to the ejected sheets is attached to a main body of an image forming apparatus instead of the paper ejection tray which receives the sheet ejected from the main body of the image forming apparatus. It is desirable that the paper ejection tray and the post-processing device are selectively attached to the main body of the apparatus such that the apparatus in which the loading tray is attached can be provided for a user for whom the post-processing is not required and such that the apparatus in which the post-processing device is attached can be provided for the user for whom the post-processing is required. In JP-A No. 61-119562, it is described that a mode in which the paper ejection tray is attached to the main body of the apparatus is equal to the mode in which the post-processing device is attached to the main body of the apparatus.

In the prior art shown in FIG. 13 (JP-A No. 06-016279), when the feed path guide 504*c* and the paper ejection tray 505 are integrally rotated in order to perform the jam disposal generated in the reverse feed path 504*b*, there is a fear that the sheet loaded on the paper ejection tray 505 falls down from an end portion 505*a* side of the paper ejection tray 505. When a capacity of the paper ejection tray is largely increased, because the user is required to operate the paper ejection tray having a heavy weight in which the many sheets are loaded in order to perform the jam disposal, operability becomes worse.

In the configuration disclosed in JP-A No. 11-143156, in which the paper ejection tray is rotated about the rotation axis extending in the vertical direction and the feed guide forming the feed path of the sheet is moved in conjunction with the rotation of the paper ejection tray, the rotation axis of the paper ejection tray is provided on one end side in the vertical direction with respect to the ejection direction of the sheet. It is necessary to rotate the paper ejection tray to about 90° in order to sufficiently open the feed path, so that a space for the rotation of the paper ejection tray is largely required in the side direction of the image forming apparatus. Therefore, a floor space required for the image forming apparatus is large.

The configuration in which the sorter is slidably moved is disclosed in JP-U No. 58-152642. However, after the user slides the sorter, the user is required to perform the operation for opening the feed path as the further additional operation, so that the operability is worse.

Further, the configuration in which the paper ejection tray and the post-processing device are selectively attached to the main body of the apparatus is not disclosed in any above-described reference which describes the prior art.

On the other hand, in the configuration described in JP-A No. 61-119562, the paper ejection tray and the post-processing device are selectively attached to the main body of the apparatus. However, in this publication, there is no disclosure concerning the configuration which disposes of the jam generated in the feed path led to the sheet ejection unit of the main body of the apparatus.

SUMMARY OF THE INVENTION

In view of the foregoing, it is an object of the invention to improve operability in disposing of a jam generated in a sheet feed path in a sheet processing device in which a ejection tray and a post-processing device can be selectively attached to the main body of the apparatus.

In order to achieve the above-described object, an image processing apparatus of the invention comprises: a sheet supply unit which supplies a sheet; an image processing unit which performs image processing to the sheet supplied by the sheet supply unit; a sheet feed path which guides the sheet in which the image processing is performed by the image processing unit; a sheet ejection unit which ejects the sheet guided by the sheet feed path, the sheet ejection unit ejecting the sheet to an ejection tray or a post-processing device for performing post-processing to the sheet, the ejection tray and the post-processing device being selectively attached to an apparatus main body; and a support unit which slidably supports the post-processing device attached to the apparatus main body while slidably supporting the ejection tray attached to the apparatus main body, wherein the sheet feed path is opened and closed in conjunction with the slide movement of the ejection tray when the ejection tray is attached to the apparatus main body, and the sheet feed path is opened and closed in conjunction with the slide movement of the post-processing device when the post-processing device is attached to the apparatus main body.

BRIEF DESCRIPTION OF THE DRAWINGS

FIG. 4 is an explanatory view of the state in which the ejection tray has been drawn in jam disposal or the like;

DESCRIPTION OF THE PREFERRED EMBODIMENT

A copying machine will be illustratively described as an image processing apparatus according to an embodiment of the invention.

Figure 1:
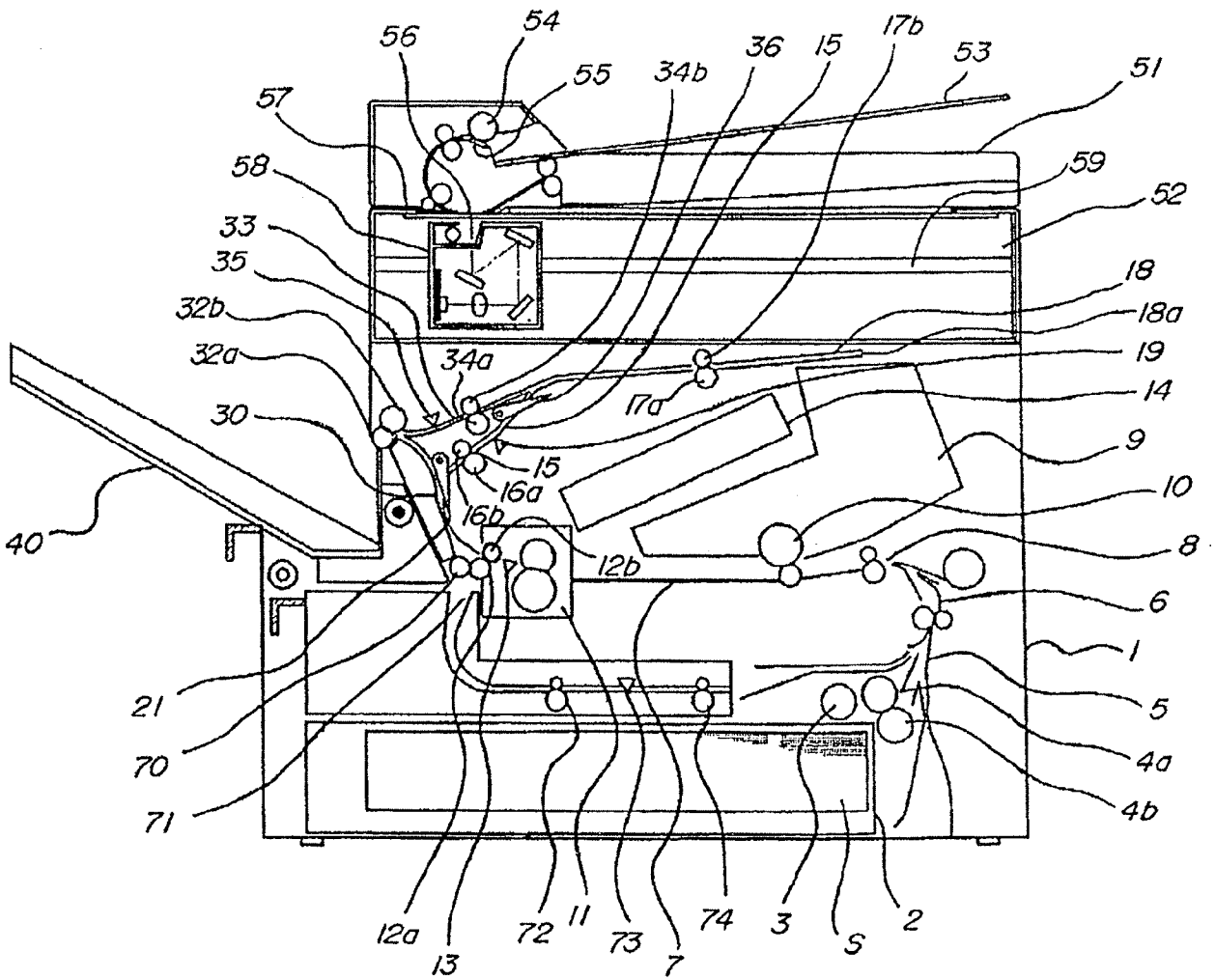
FIG. 1 is a schematic sectional view for explaining an image forming apparatus.

FIGS. 1 to 6 show the embodiment of the invention. FIG. 1 is a schematic sectional view for explaining the image forming apparatus which includes image forming means for forming the image in the sheet by electrophotography as the image processing unit.

[Overall Configuration]

A configuration of the image forming apparatus will be described. In FIG. 1, reference numeral 1 designates a printer including an image reading unit. A supply cassette 2 constituting a sheet supply unit, a supply roller 3 which delivers a sheet from the supply cassette 2, and separating and feeding rollers 4*a* and 4*b* which separate the delivered sheet one by one are arranged in a lower portion of the printer 1.

The sheet delivered from the sheet supply unit is fed to an image forming unit through feed paths 5, 6, and 7, resist rollers 8, and the like. The image forming unit includes an image forming process unit (hereinafter referred to as "cartridge") 9 having an image forming drum 10 and the like. In the embodiment, the image is exposed from a scanner 14 to the image forming drum 10, the toner image is formed by the well-known electrophotography, and the toner image is transferred to the fed sheet.

The sheet in which the image has been formed is heated and pressurized with a heating and fixing device 11 to fix the toner image, and then the sheet is ejected onto an ejection tray 40 serving as an ejection unit by post-fixing ejection rollers 12*a* and 12*b* and an upper ejection roller 32*a* and a lower ejection roller 32*b*. The upper ejection roller 32*a* and the lower ejection roller 32*b* constitute a sheet ejection unit.

The image reading unit is arranged in an upper portion of the printer 1. As shown in FIG. 1, the image reading unit includes a scanner unit 52 and an ADF (Automatic Document Feeder) 51. The ADF 51 is one which optically reads information described in a document in such a manner that the plurality of documents loaded on a document loading tray 53 are separated and fed one by one by a supply roller 54 and a separating pad 55 and the document passes through a document reading position 56. The ADF 51 can be opened backward about a hinge (not shown) located at the back of the apparatus, and the ADF is opened in the case where the document is placed on a document table glass 57.

A normal scanner unit is used as the scanner unit 52, in which an optical carriage 58 reads the information described in the document placed on the document table glass 57 while laterally scanning the document along a guide shaft 59 to perform photoelectric conversion by a CCD. When the ADF 51 reads the document, the optical carriage 58 is stopped at a predetermined position to read the document which is being fed. The detail description of the scanner unit will be omitted.

[Sheet Conveying Path]

In the embodiment, two sheet conveying paths are provided in order to eject the sheet to the ejection tray 40. One of the two sheet conveying paths is a first sheet conveying path 15, in which the sheet is conveyed to above the scanner 14 in a switchback manner by the pair of post-fixing ejection rollers 12*a* and 12*b* and the sheet is reversely conveyed and ejected. The other is a second sheet conveying path 30, in which the sheet is directly ejected from the heating and fixing device 11 to the ejection tray 40.

A change of the sheet conveying path to the sheet conveying path 15 is switched by an FD/FU flapper 21 provided on a downstream side in a sheet conveying direction of the pair of post-fixing ejection rollers 12*a* and 12*b* (hereinafter simply referred to as "downstream side"). A pair of merging rollers 16*a* and 16*b* is provided at an intermediate portion of the first feed path which is located on the downstream side of the flapper 21, and a pair of reverse rollers 17*a* and 17*b* is provided above the image forming unit.

The pair of reverse rollers 17*a* and 17*b* has the configuration which can reverse the sheet conveying direction in order to feed the sheet to a third sheet conveying path 33 described later. A drawing feed path 18 is formed on the further downstream side of the pair of reverse rollers 17*a* and 17*b*, and an end portion 18*a* of the drawing conveying path 18 has a shape of the rounded conveying path such that a front end of the sheet does not pass through above the cartridge 9 to go outside the apparatus. A sheet detector 19 is provided in the intermediate portion of the first sheet conveying path 15.

The second sheet conveying path 30 which directly ejects the sheet to the ejection tray 40 is switched by the FD/FU flapper 21. In the second sheet conveying path, the sheet is ejected to the ejection tray 40 through the pair of the upper ejection roller 32*a* and the lower ejection roller 32*b*. In this case, face-up ejection is performed.

Further, the third sheet conveying path 33 which connects between the pair of reverse rollers 17*a* and 17*b* and the pair of the upper ejection roller 32*a* and the lower ejection roller 32*b* is provided, and a pair of convey rollers 34*a* and 34*b* and a sheet detector 35 are provided in the intermediate portion of the third sheet conveying path 33.

A reverse flapper 36 is provided in front of the pair of reverse rollers 17*a* and 17*b* and in the vicinity of a merging portion of the first sheet conveying path 15 and the third sheet conveying path 33. The reverse flapper 36 is always biased toward the side in which the first sheet conveying path 15 is closed. It is also possible that the reverse flapper 36 has the configuration in which biasing force is lightly set and the reverse flapper 36 is pushed out to be opened by convey force of the sheet, or it is also possible that the reverse flapper 36 has the configuration in which the sheet conveying paths are switched at certain timing by a solenoid or the like. When the sheet is ejected to the ejection tray 40 through the first sheet conveying path 15 and the third sheet conveying path 33, the face down ejection is performed.

With reference to the reverse timing, for example, the front end or the rear end of the sheet which is running on the first sheet conveying path 15 is detected by the sheet detector 19, and the pair of reverse rollers 17*a* and 17*b* is reversed at the time when the rear end of the sheet passes through the flapper 21 by a predetermined amount. Then, the rear end of the sheet at that time is led to the third sheet conveying path, and delivery and receipt are performed between the pair of convey rollers 34*a* and 34*b* by the predetermined amount or for a predetermined time interval. Then, the sheet is ejected to the ejection tray 40 through the pair of the upper ejection roller 32*a* and the lower ejection roller 32*b*.

Figure 2:
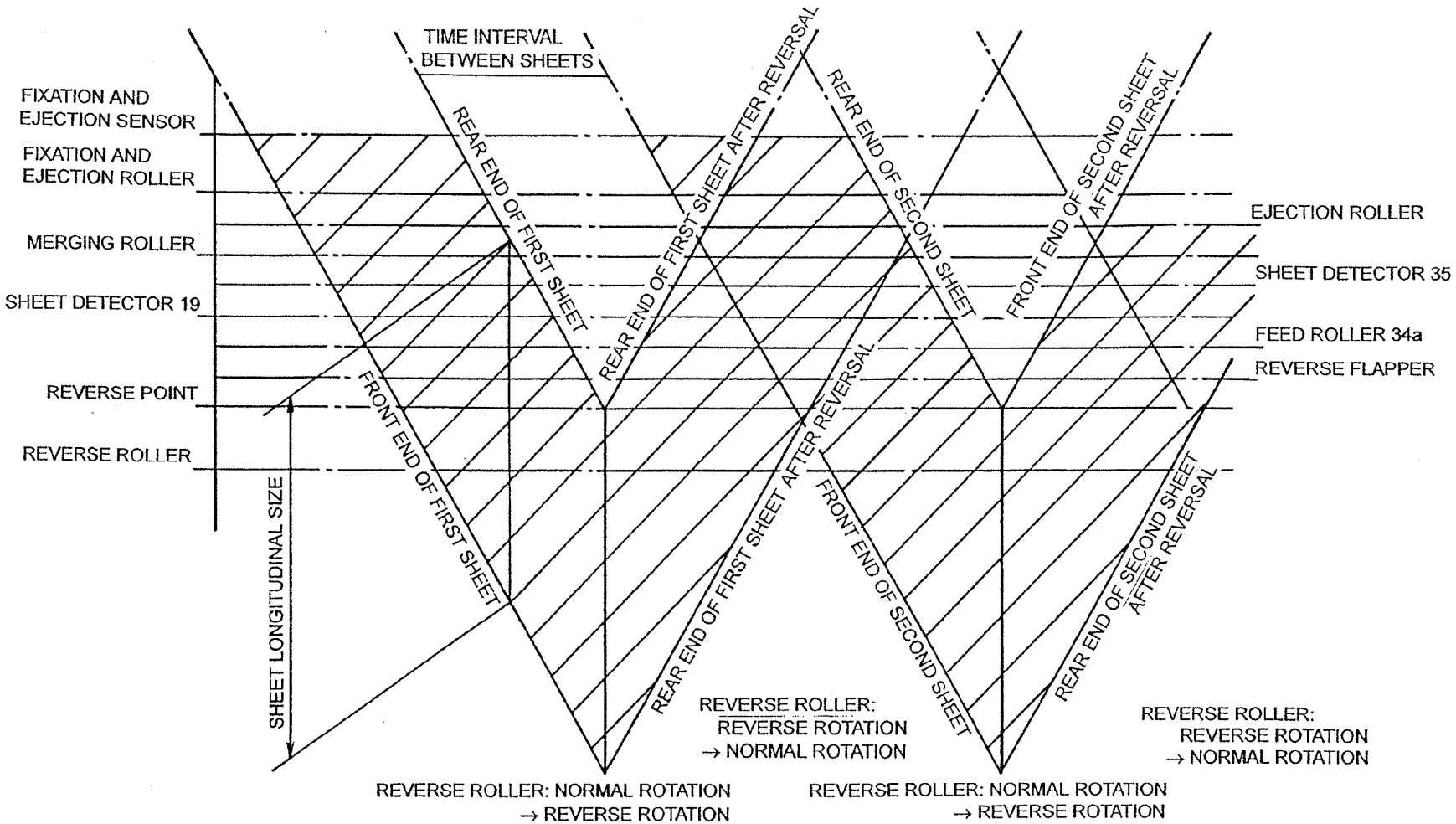
FIG. 2 is an explanatory view of a sheet feed state when a sheet is ejected to an ejection tray.

FIG. 2 is an explanatory view of a sheet conveying state when the sheet is ejected to the ejection tray 40. A sheet existing area is hatched in the range of the post-fixing ejection rollers 12*a* to the upper ejection roller 32*a*.

As can be seen from FIG. 2, the sheet is turns around at the time when the rear end of the sheet runs on by the predetermined amount after passing through the reverse flapper 36, the sheet enters the third sheet conveying path 33 to pass through the pair of feed rollers 34*a* and 34*b* and the pair of the upper ejection roller 32*a* and the lower ejection roller 32*b*, and then the sheet is ejected.

Figure 12:
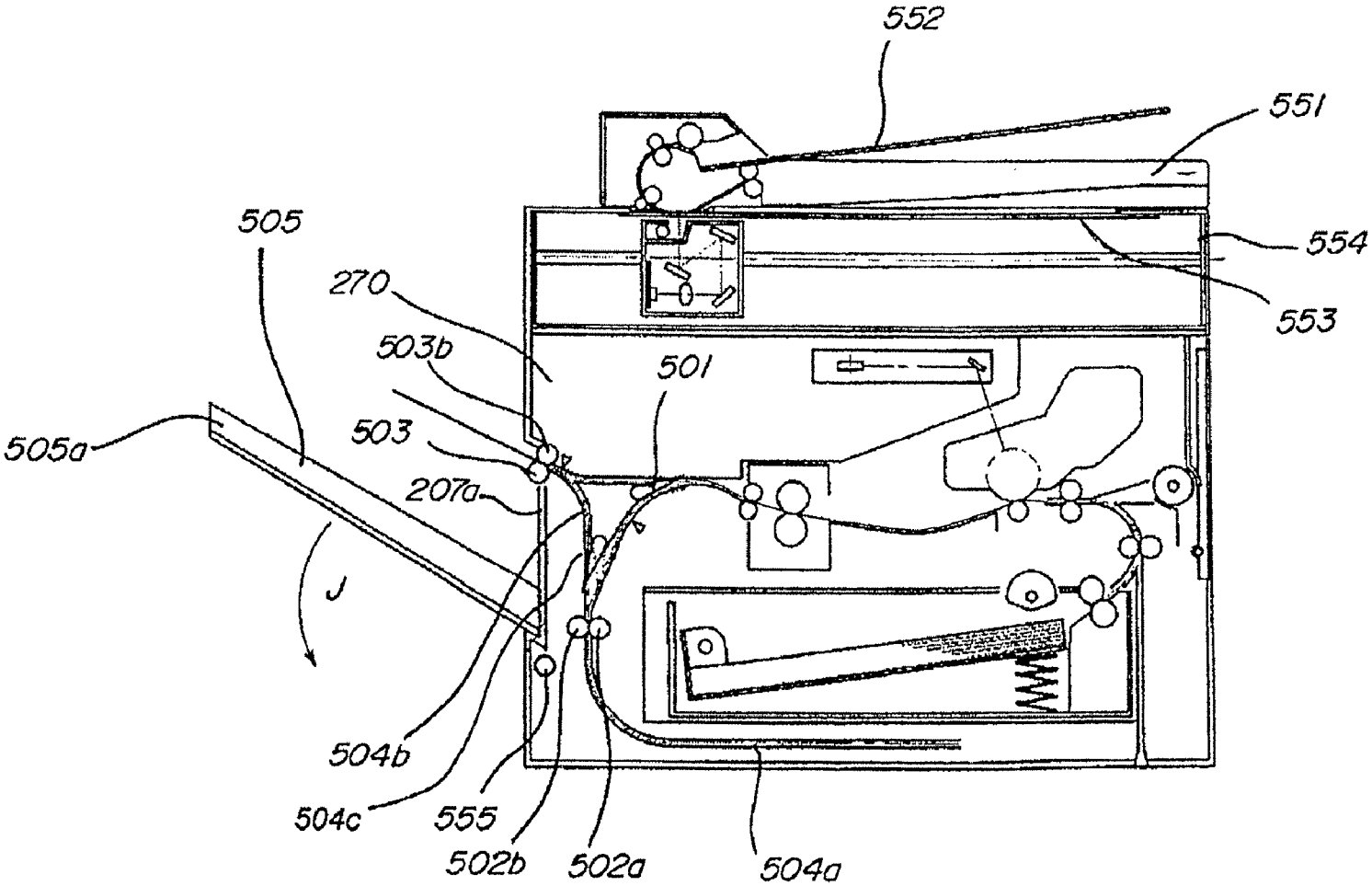
FIG. 12 is a sectional view for explaining the conventional disk-top type of copying machine.
Figure 13:
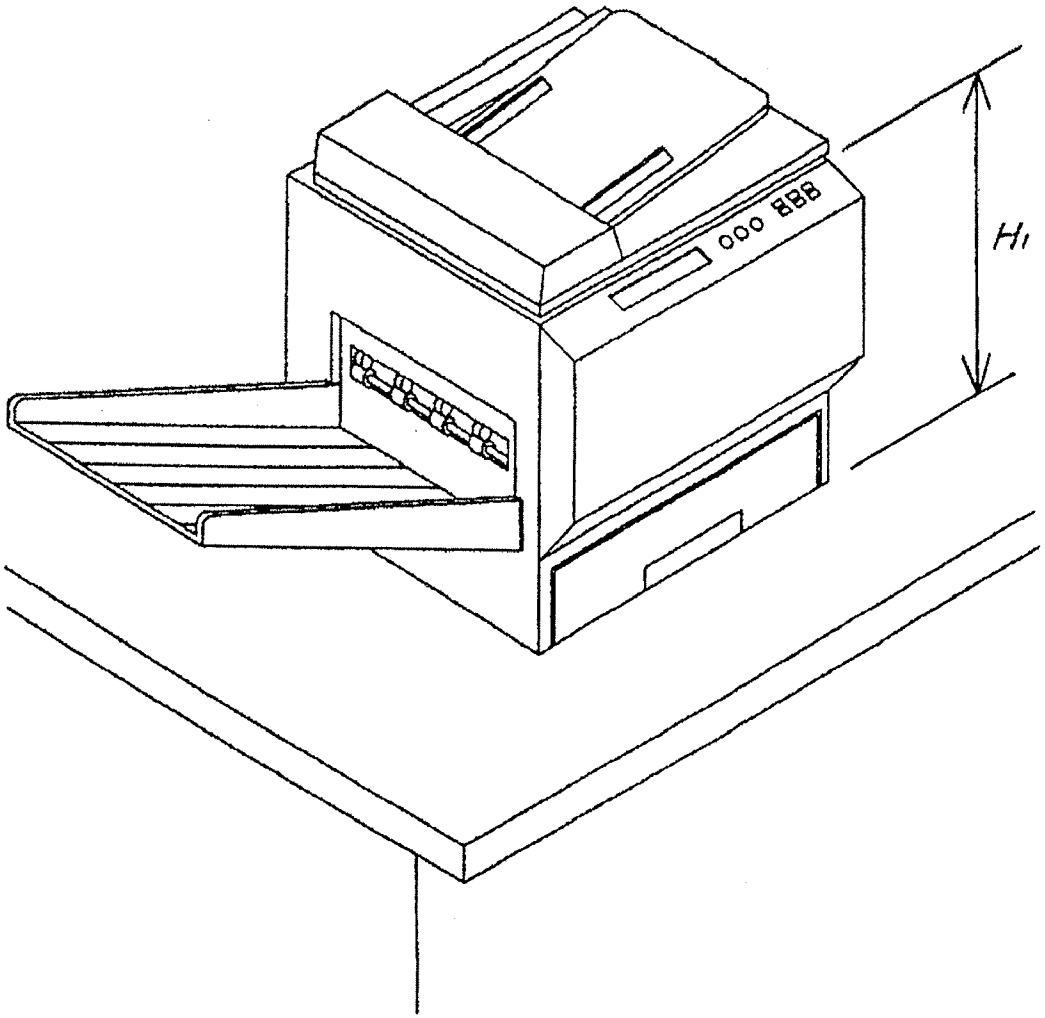
FIG. 13 is a perspective view explaining the conventional disk-top type of copying machine.

As described above, the first sheet conveying path 15 serving as the switchback conveying path is arranged above the image forming unit, and the sheet supply unit is arranged below the image forming unit. Therefore, while sheet ejection and load capacity can be increased, a supply cassette area can be enlarged. When compared to the conventional configuration shown in FIG. 12 in which the sheet reverse mechanism unit is provided on the side of the fixing device and the sheet reverse mechanism unit is rounded toward the lower portion of the apparatus, extensibility such as double-sided support and a feed option is improved while a width of the apparatus can be reduced and a height of the apparatus can be lowered.

Then, the configuration in which a double-sided conveying path provided in the lower portion of the printer 1 is arranged will be described. A double-sided pressurizing roller 70 is provided on the downstream side of the heating and fixing device 11 so as to form a nip with the post-fixing ejection roller 12*a*. A double-sided conveying path 71 is led to downward from the nip, and a pair of double-sided first conveying rollers 72, a pair of double-sided second conveying rollers 74, and a double-sided sheet sensor 73 are provided along the double-sided feed path 71. Then the double-sided path 71 merges with the feed path 6 again.

The sheet is temporarily led to the first sheet conveying path 15 by the FD/FU flapper 21. After the rear end of the sheet passes through the pair of post-fixing ejection rollers 12*a* and 12*b* by the predetermined amount, the pair of merging rollers 16*a* and 16*b* and the pair of reverse rollers 17*a* and 17*b* are reversed to feed the sheet to the double-sided conveying path 71. The double-sided reversal is performed at the time when the front end or the rear end of the sheet is detected by a fixation and ejection sensor 13. Then the sheet which enters the double-sided conveying path 71 is fed to the feed path 6 again at predetermined timing.

[Slide Configuration of Ejection Tray, and Opening and Closing Configuration of Second Sheet Conveying Path]

In the image forming apparatus of the embodiment, in order to simplify jam disposal and the like in the second sheet conveying path 30 which directly ejects the sheet to the ejection tray 40, while the ejection tray is slidably formed, the second sheet conveying path 30 is formed so as to be openable and closable in conjunction with the ejection tray 30. Then, a slide moving mechanism of the ejection tray 40 and an opening and closing configuration of the second sheet conveying path 30 will be described referring to FIGS. 3 to 6.

Figure 3:
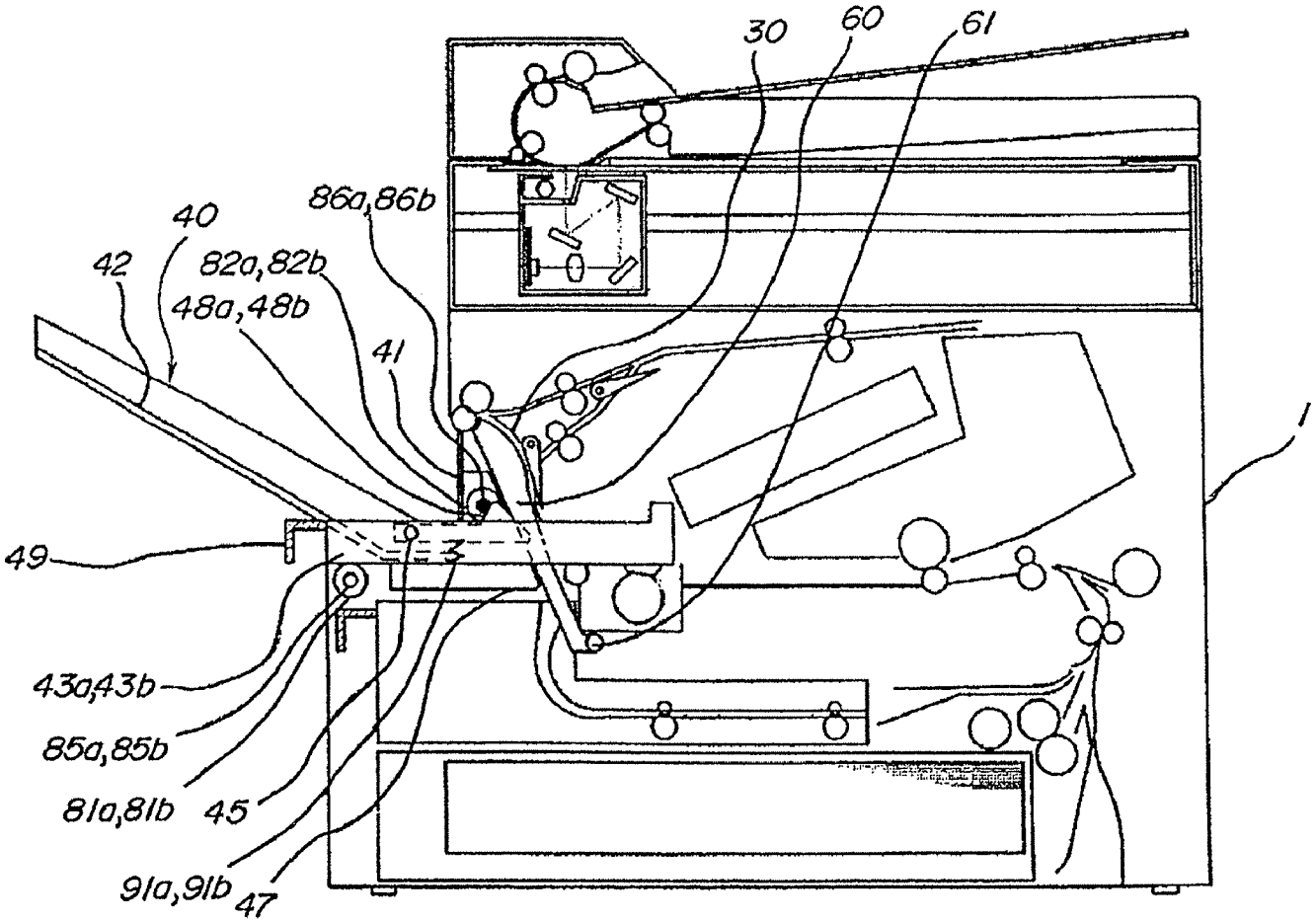
FIG. 3 is an explanatory view of a state in which the ejection tray is attached.
Figure 4:
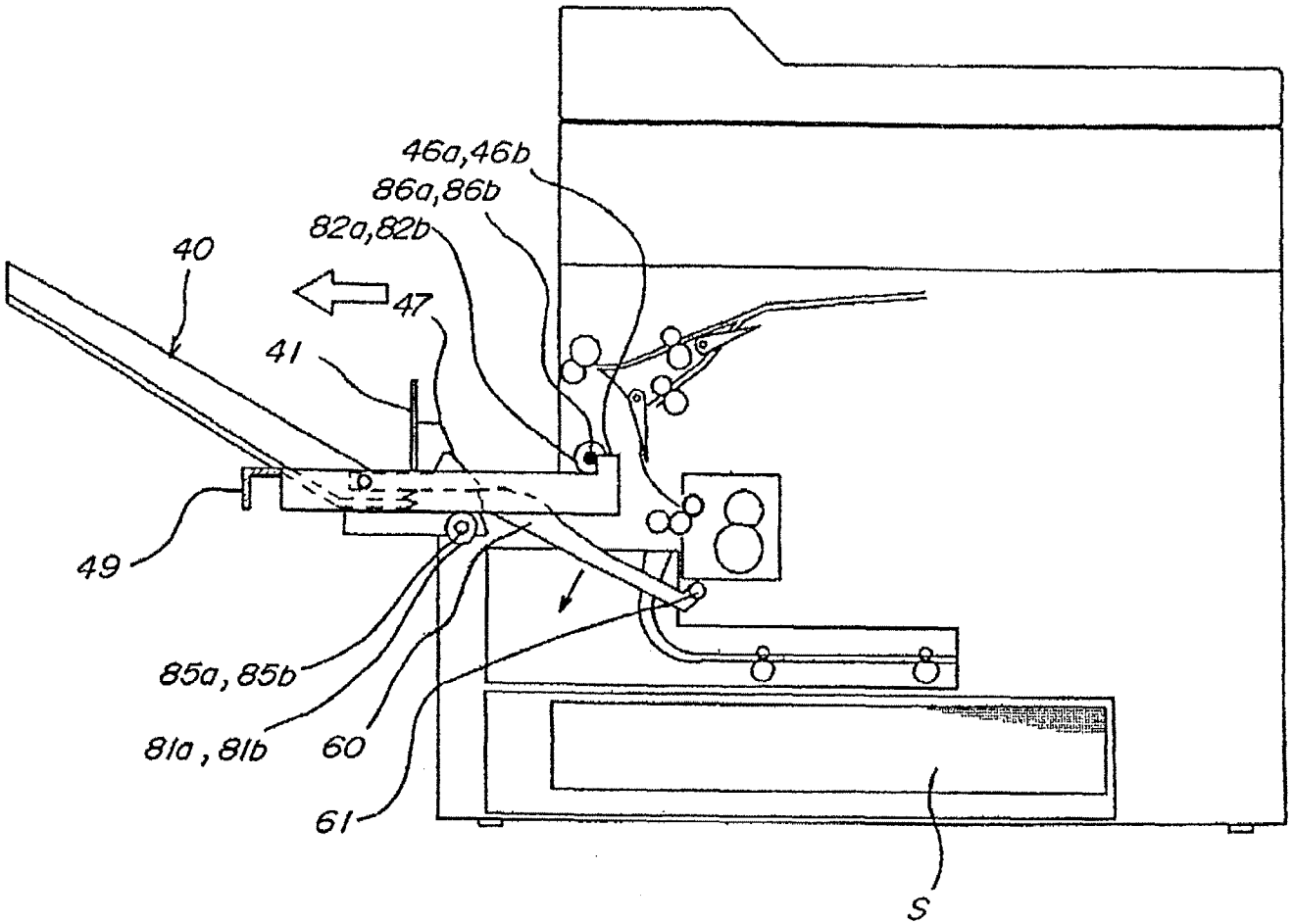
Figure 5:
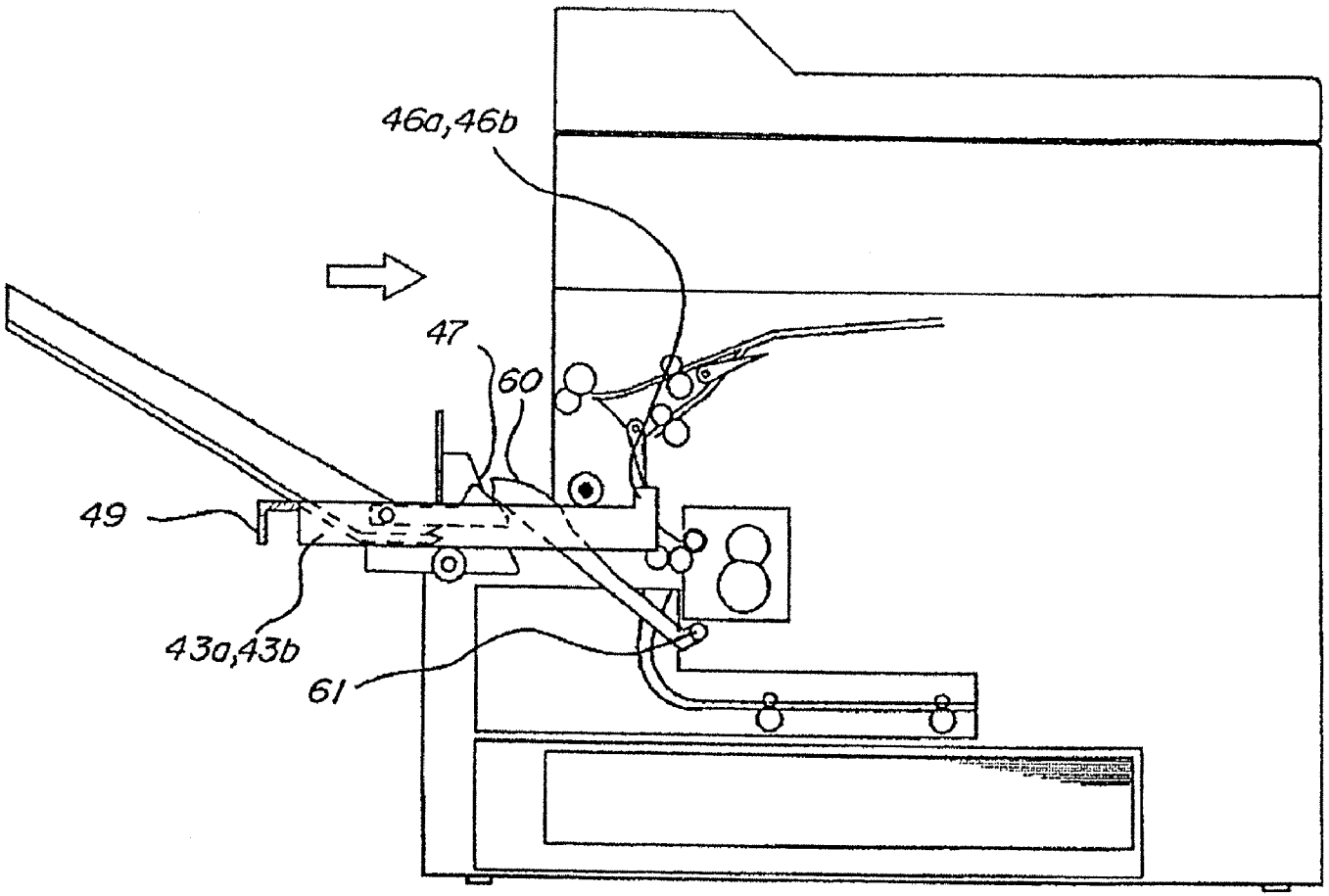
FIG. 5 is an explanatory view of the state in which the ejection tray is pushed.
Figure 6:
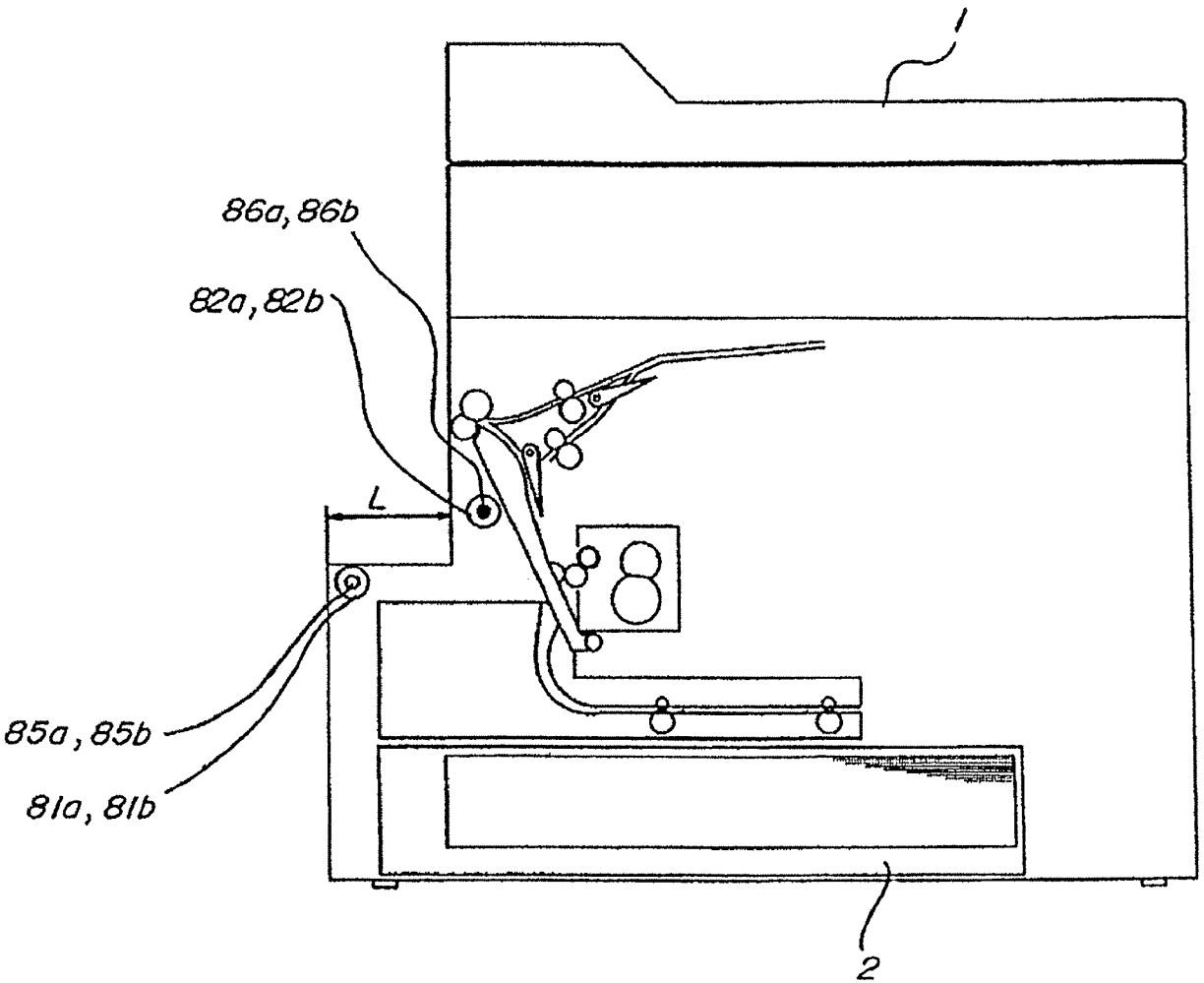
FIG. 6 is an explanatory view of the state in which the ejection tray has been detached.
Figure 7:
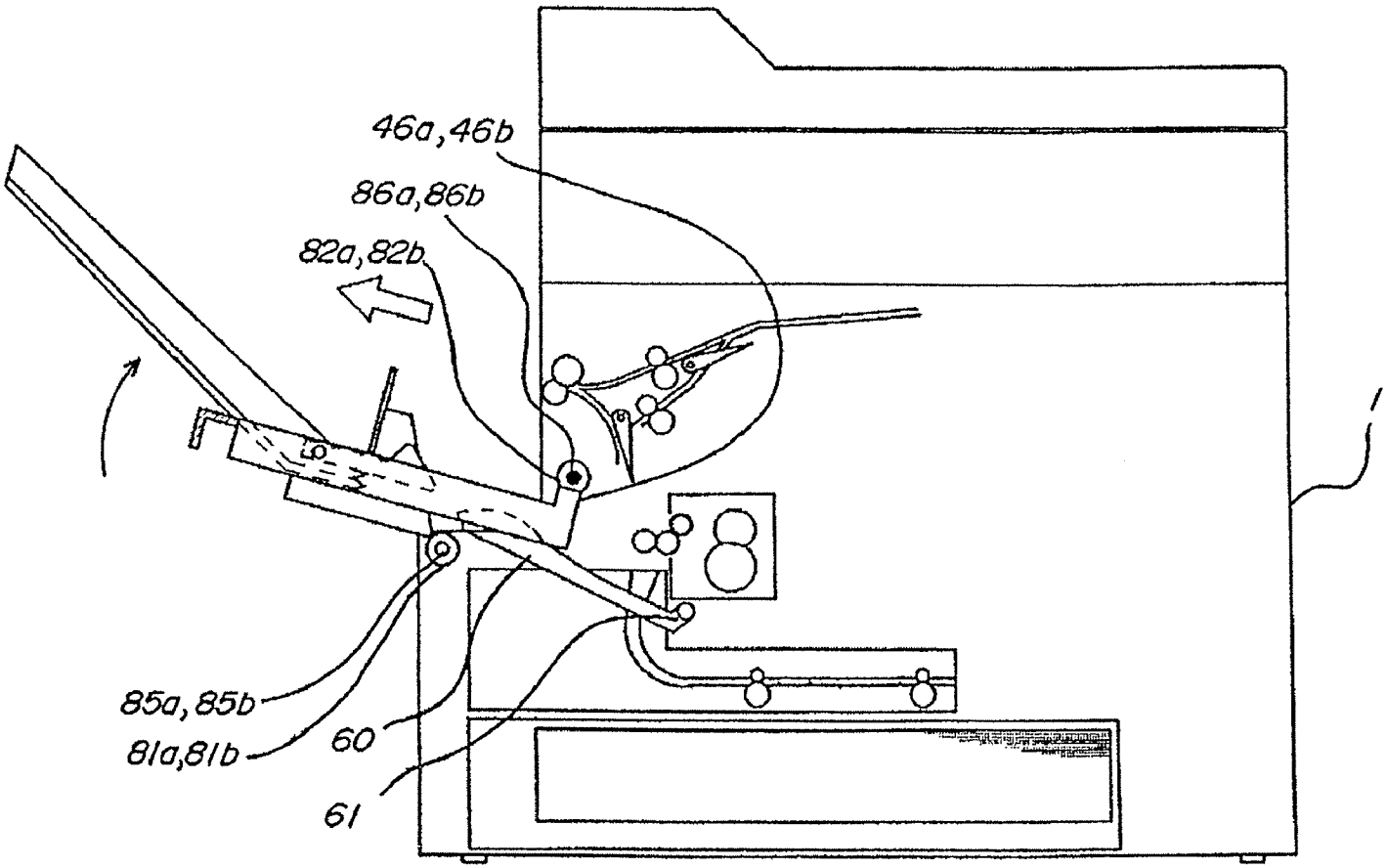
FIG. 7 is an explanatory view of the state in which the standard ejection tray is detached.
Figure 8:
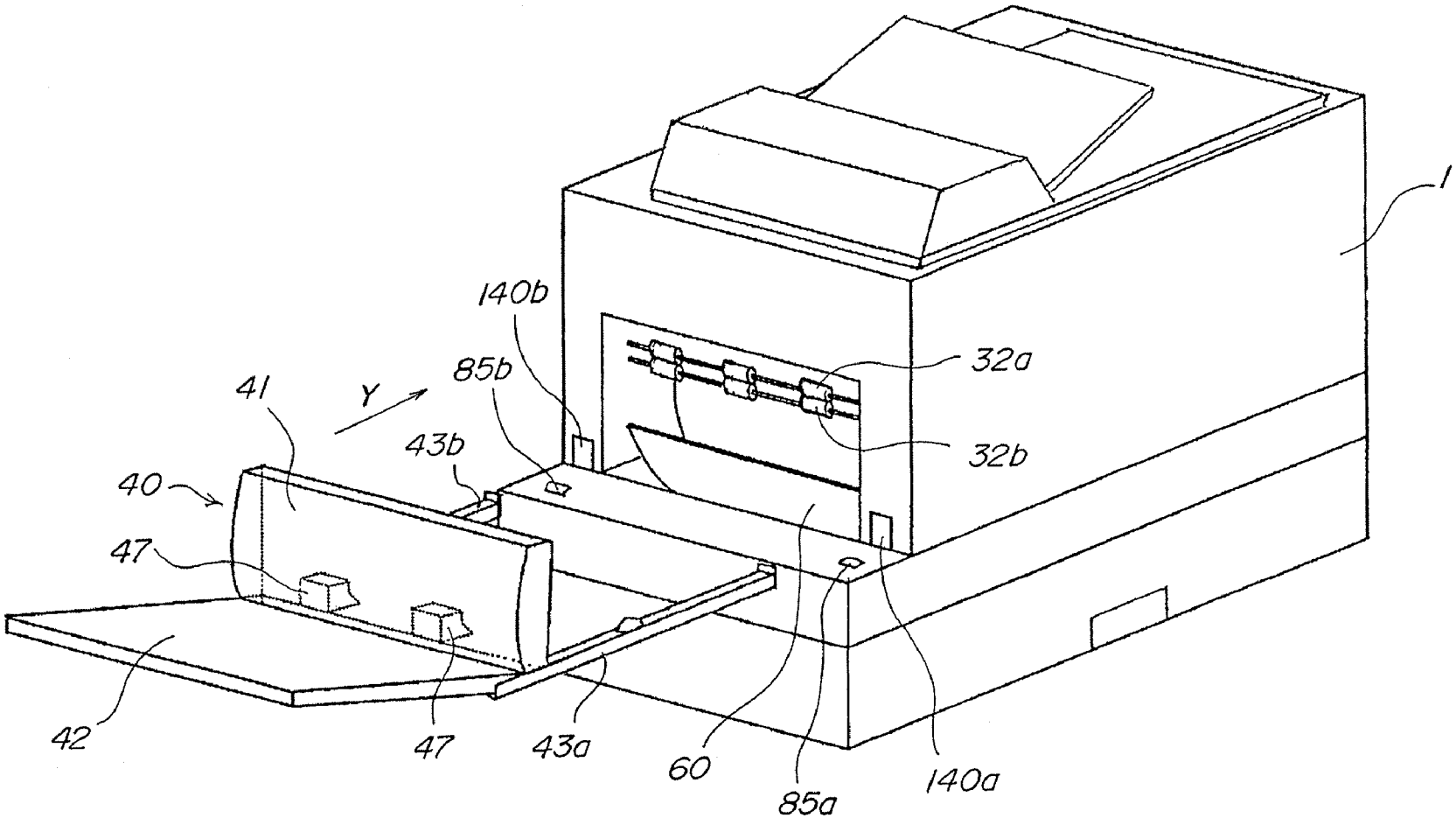
FIG. 8 is a perspective view of the image forming apparatus in which the ejection tray has been detached.

FIG. 3 is an explanatory view of a state in which the ejection tray is attached, FIG. 4 is an explanatory view of a state in which the ejection tray has been drawn in the jam disposal or the like, FIG. 5 is an explanatory view of a state in which the ejection tray is pushed, FIG. 6 is an explanatory view of a state in which the ejection tray has been detached, FIG. 7 is an explanatory view of a state in which the standard ejection tray is detached, and FIG. 8 is a perspective view of the image forming apparatus in which the ejection tray has been detached.

As mentioned above, the second sheet conveying path 30 is the sheet path located between the pair of post-fixing ejection rollers 12*a* and 12*b* and the pair of the upper ejection roller 32*a* and the lower ejection roller 32*b*.

The case in which the front end of a sheet S in which the image has been recorded is jammed in the second sheet conveying path 30 will be described here.

The ejection tray 40 shown in FIG. 3 includes a load wall 41, a tray 42, a front rail 43*a* which is fixed to the front side (frontal side of FIG. 3) of the tray 42, and a rear rail 43*b* which is fixed to the rear side (far side of FIG. 3) of the tray 42. A front latch 48*a* and a rear latch 48*b* are provided in the front rail 43*a* and the rear rail 43*b*, respectively. The front latch 48*a* and the rear latch 48*b* are rotatable about a rotation center 45, and the front latch 48*a* and the rear latch 48*b* are biased in a counterclockwise direction of FIG. 3 by springs 91*a* and 91*b*. Movements of the front rail 43*a* and the rear rail 43*b* are controlled in such a manner that the front latch 48*a* and the rear latch 48*b* are locked by latching onto roller shafts 86*a* and 86*b*, and the front rail 43*a* and the rear rail 43*b* become movable by releasing the lock. A flip-up member 47 is provided in the ejection tray 40.

The front rail 43*a* and the rear rail 43*b* are provided along a movement direction of the ejection tray 40 while formed in a rod shape. The front rail 43*a* and the rear rail 43*b* intrude into the printer 1, and the front rail 43*a* and the rear rail 43*b* are slidably supported by rollers 81*a* and 82*a* and rollers 81*b* and 82*b*. The rollers 81*a* and 82*a* are of a support unit attached to a front frame of a main body of the apparatus, and the rollers 81*b* and 82*b* are attached to a rear frame. Namely, the rollers 81*a*, 82*a*, 81*b*, and 82*b* support the ejection tray 40 such that the ejection tray 40 can horizontally slide. The front rail 43*a* and the rear rail 43*b*, which are of the supported member supported by the rollers 81*a*, 82*a*, 81*b*, and 82*b*, abut on the rollers 81*a*, 82*a*, 81*b*, and 82*b*. The front rail 43*a* and the rear rail 43*b* become guide members which guide the slide movement of the ejection tray 40. The rollers 81*a* and 82*a* are journaled in shafts 85*a* and 86*a* provided in the front frame of the main body of the printer 1, and the rollers 81*b* and 82*b* are journaled in shafts 85*b* and 86*b* provided in the rear frame.

In the embodiment, the front rail 43*a* and the rear rail 43*b* are also used as the frame of ejection tray 40, and frame strength of the ejection tray 40 is increased by the front rail 43*a* and the rear rail 43*b*. The ejection tray 40 overhangs onto the left side of FIG. 3 with respect to the main body of the apparatus to generate moment in the counterclockwise direction about the lower rollers 81*a* and 81*b* while the ejection tray is attached, so that the front rail 43*a* and the rear rail 43*b* are supported by the lower rollers 81*a* and 81*b* and the upper rollers 82*a* and 82*b*.

A large load is applied to the rollers and the shaft, because many sheets ejected from the image forming apparatus are loaded on the ejection tray 40. Particularly, in the jam disposal of the second sheet conveying path 30 while the many sheets are loaded on the ejection tray 40, the load is significantly applied to the rollers and the shaft when the ejection tray 40 is caused to slide.

In the embodiment, as shown in FIG. 6, the printer 6 has the shape in which the sheet supply unit in which the supply cassette 2 and the like are arranged is laterally protruded (toward the left side of FIG. 6) from the sheet ejection unit which is arranged above the sheet supply unit and formed by the pair of the upper ejection roller 32*a* and the lower ejection roller 32*b*. Namely, the sheet ejection unit is formed to be retreated toward the main body from the sheet supply unit. The shafts 85*a* and 85*b* and the rollers 81*a* and 81*b* which receive the load of the rails 43*a* and 43*b* are arranged above the sheet supply unit in an interval L where the sheet ejection unit is protruded from the sheet supply unit. The width of the apparatus can be decreased by the above-described configuration, when compared to the conventional configuration shown in FIG. 12 in which the sheet reverse mechanism unit is provided on the side of the fixing device and the sheet reverse mechanism unit is rounded toward the lower portion of the apparatus.

Therefore, the position receiving the load of the ejection tray 40 is located above the end portion of the sheet supply unit. In the state in which the sheets are loaded on the tray 42 to which the maximum load is applied and the ejection tray 40 is drawn to the left side in order to perform the jam disposal as shown in FIG. 4, the load of the ejection tray 40 is applied downward to the shafts 85*a* and 85*b*, and the load of the ejection tray 40 is applied upward to the shafts 86*a* and 86*b*.

In the embodiment, in order that the end portions of the frame in the vertical direction in the interval L where the sheet supply unit is protruded from the image forming apparatus and at the right and left ends of L in FIG. 6 maintain the sufficient strength, i.e. the frame portions in which the shafts 85*a* and 85*b* and the shafts 86*a* and 86*b* are provided at the position receiving the load maintain the sufficient strength, the frame above the sheet supply unit has high mechanical strength because the frame is made of sheet metal and formed by a drawing shape or a bending shape.

Thus, since the load of the drawable ejection tray 40 is supported by the frame portions having the sufficient strength, the position which receives the load becomes optimum and the sufficient strength is obtained.

Since the sheet ejection unit is retreated by the width L toward the inside of the main body from the sheet supply unit, the ejection tray 40 can overlap with the image forming apparatus by the retreated length L. Therefore, the width of the apparatus can be decreased.

An FU guide 60 forming the guide outside the second sheet conveying path 30 generates the moment in the counterclockwise direction of FIG. 3 about a rotation center 61 by deadweight. The FU guide 60 serving as the sheet guide is controlled at the position shown in FIG. 3 in such a manner that the flip-up member 47 serving as an abutting unit provided on the ejection tray 40 abuts on the FU guide 60.

When a user performs the jam disposal of the sheet S jammed in the second sheet conveying path 30, as shown in FIG. 4, the user puts user's hand on a handle 49 of the ejection tray 40 to draw the ejection tray 40 toward the left side.

As shown in FIG. 4, the front latch 48*a* and the rear latch 48*b* are rotated clockwise by drawing the ejection tray 40 to be unlocked from the roller shafts 86*a* and 86*b*, and the ejection tray 40 slides toward the left side (arrow direction). In the slide operation, the ejection tray 40 can be drawn up to the range where stopper portions 46*a* and 46*b* provided at the end portions of the front and rear rails 43*a* and 43*b* abut on shaft portions of the rollers 82*a* and 82*b*.

As shown in FIG. 4, in conjunction with the slide operation of the ejection tray 40, the flip-up member 47 is also retreated toward the left side to rotate the FU guide 60 in the counterclockwise direction about the rotation center 61 by the deadweight, which allows the second sheet conveying path 30 to be sufficiently released. Therefore, the user can access the sheet S.

When the user finishes the jam disposal of the sheet S, as shown in FIG. 5, the user puts user's hand on the handle 49 to slide the ejection tray 40 toward the right side. Therefore, the flip-up member 47 abuts on the FU guide 60 to rotate the FU guide 60 clockwise, and the ejection tray 40 slides to the position where the ejection tray 40 is latched and forms the second sheet conveying path 30.

The second sheet conveying path 30 is opened and closed in conjunction with the slide operation of the ejection tray 40 by the above-described configuration, so that the user can easily perform the jam disposal of the sheet.

Although the configuration in which the FU guide 60 is rotated by the deadweight in conjunction with the slide operation of the ejection tray 40 in the left direction of FIG. 4 has been shown as an example in the embodiment, it is also possible that the FU guide 60 is rotated by the spring which biases the FU guide 60 toward the direction in which the sheet conveying path is opened.

According to the configuration of the above-described embodiment, the apparatus having ease of use, excellent option extensibility, and less installation area can be provided.

[Attachment and Detachment of Ejection Tray]

In the image forming apparatus of the embodiment, the ejection tray 40 can be detached from the main body of the image forming apparatus and a post-processing device can be attached instead of the ejection tray 40. Namely, in the image forming apparatus, the ejection tray 40 and the post-processing process can be selectively attached.

The operation in detaching the ejection tray 40 from the main body of the apparatus will be described referring to FIG. 7.

The ejection tray 40 is slid to the position where the ejection tray 40 can be slid in maximum, namely, as shown in FIG. 4, the ejection tray 40 is slid until the stopper portions 46*a* and 46*b* provided in the end portions of the rails abut on the shafts 86*a* and 86*b*.

Then, as shown in FIG. 7, the ejection tray 40 is pulled out toward the arrow direction in such a manner that the ejection tray 40 is inclined toward the clockwise direction to be rotated to an angle in which the stopper portions 46*a* and 46*b* do not abut on the shafts 86*a* and 86*b*.

FIG. 8 is a perspective view of the image forming apparatus in which the ejection tray has been detached. When the detached ejection tray 40 is attached to the main body of the image forming apparatus, the front ends of the rails 43*a* and 43*b* provided in the ejection tray 40 are inserted into openings 140*a* and 140*b* made in the main body of the image forming apparatus, and the ejection tray 40 is inserted toward the direction of an arrow Y which is the attaching direction to the main body of the apparatus.

[Slide Configuration of Staple Stacker, and Opening and Closing Configuration of Second Sheet Conveying Path]

Figure 9:
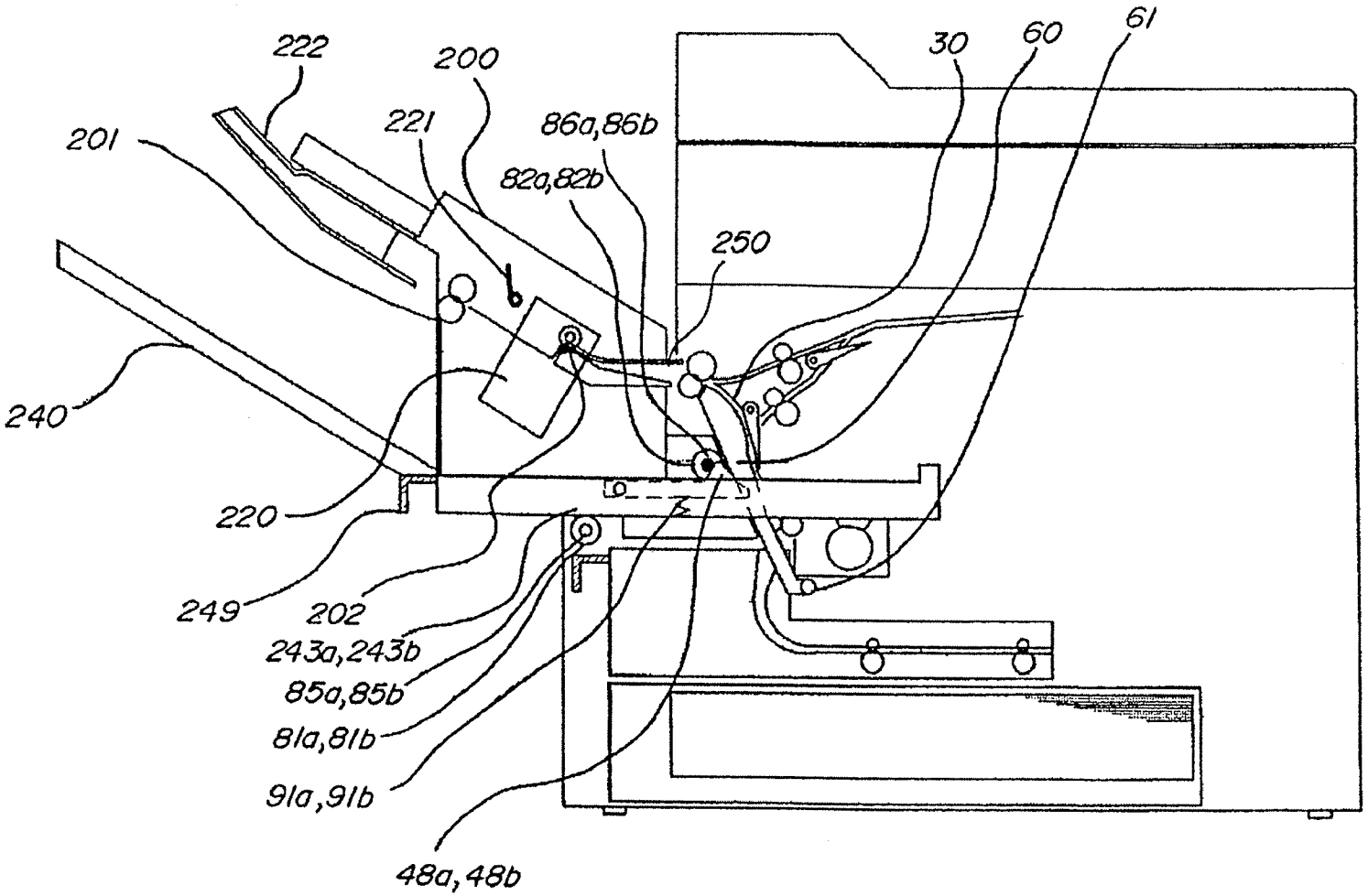
FIG. 9 is an explanatory view in which a staple stacker which can align a plurality of sheets to perform stapling processing is attached to the image forming apparatus.

FIG. 9 is an explanatory view in which a staple stacker 200 (post-processing device) which can align a plurality of sheets to perform stapling processing is attached to the main body of the image forming apparatus.

The staple stacker 200 includes a stapler 220 serving as stapling means, a paddle 221 serving as sheet conveying direction aligning means, a jogger 222 which performs alignment in the direction orthogonal to the conveying direction, a pair of inlet rollers 201, a pair of ejection rollers 202 which can be separated from each other, and a stack tray 240. The sheet ejected from the upper ejection roller 32*a* and the lower ejection roller 32*b* of the main body of the image forming apparatus to the staple stacker 200 is fed by the inlet rollers 201 and aligned by the paddle 221 and the jogger 222. After the sheet is stapled with the stapler 220, the sheet falls down from the jogger 222 and is loaded on the stack tray 240.

A front rail 243*a* and a rear rail 243*b* which are longer than the rails 43*a* and 43*b* provided in the ejection tray 40 described above are provided on the front side and the rear side of the staple stacker 200. The rails 243*a* and 243*b* of the staple stacker 200 and the rails 43*a* and 43*b* of ejection tray 40 have substantially identical configurations. The configurations of other components such as the flip-up member 47, the front and rear latches 48*a* and 48*b*, and the springs 91*a* and 91*b* are equal to those provided in the ejection tray 40.

Thus, in the staple stacker 200, a connection interface serving as connecting means to the main body of the image forming apparatus is equal to the interface of the standard ejection tray 40, so that the staple stacker 200 can be attached to the main body of the image forming apparatus when the reverse procedure of the process in which the ejection tray 40 is detached is performed.

Figure 10:
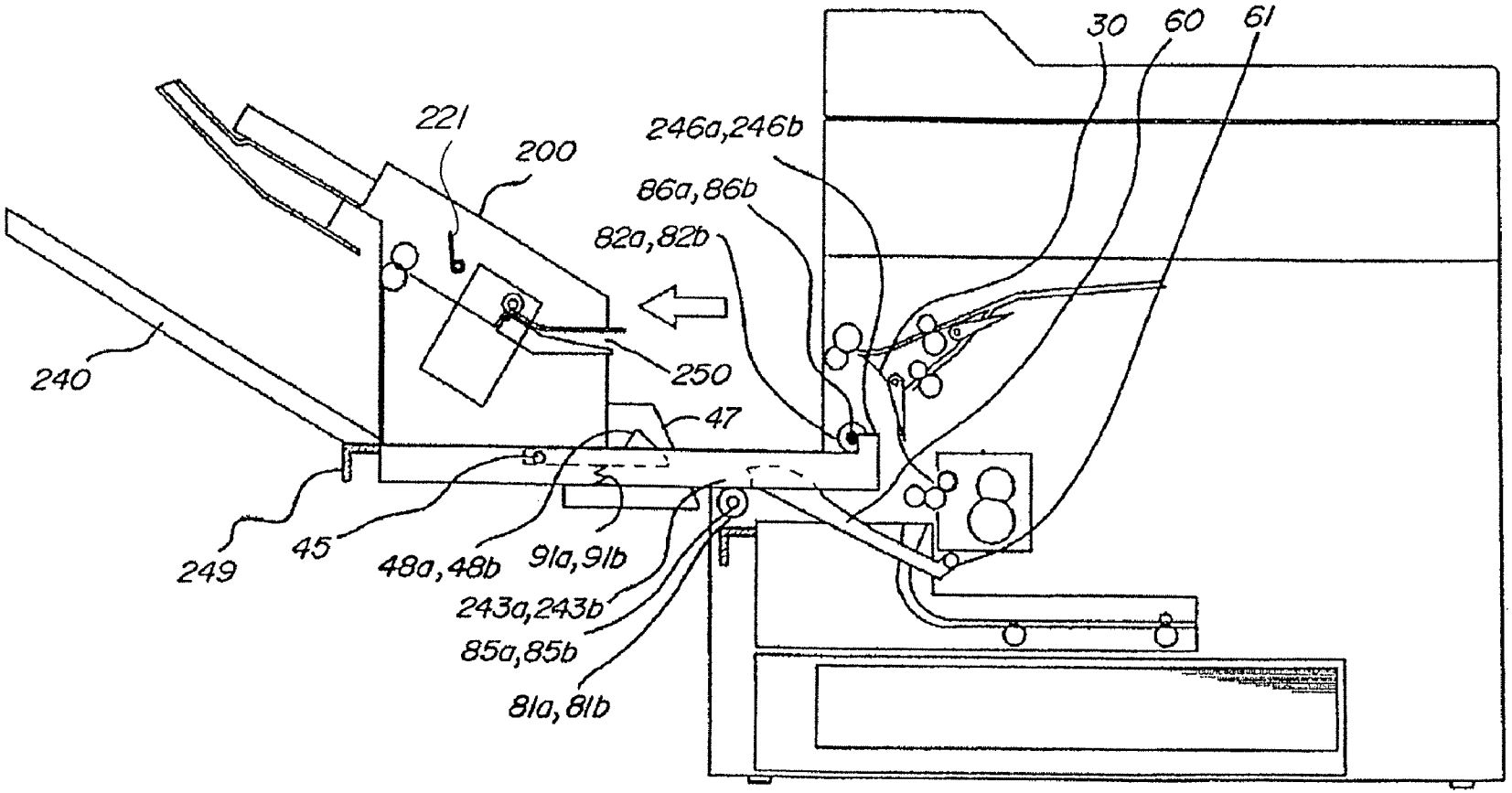
FIG. 10 is an explanatory view of the state in which the staple stacker is drawn from a main body of the image forming apparatus in order to perform the jam disposal.

FIG. 10 is an explanatory view of a state in which the staple stacker 200 is drawn toward the left side in order to perform the jam disposal.

When the staple stacker 200 is drawn, similarly to the jam disposal of the ejection tray 40, the user puts user's hand on a handle 249 of the staple stacker 200 to draw the staple stacker 200 until stopper portions 246*a* and 246*b* abut on the shafts 86*a* and 86*b*.

Since the rails 243*a* and 243*b* provided in the staple stacker 200 are longer than the rails provided in the ejection tray 40, the amount of draw can be increased. When the staple stacker 200 is drawn, the second sheet conveying path 30 is also opened and closed in conjunction with the slide operation, so that the user can easily perform the jam disposal of the sheet. Further, the jam disposal can be performed in an inlet portion 250 of the staple stacker 200.

The staple stacker 200 can be detached from the main body of the apparatus in the same procedure as the ejection tray 40. When the staple stacker 200 is attached to the main body of the apparatus, similarly to the ejection tray 40, the front ends of the rails 243*a* and 243*b* of the staple stacker 200 are inserted into the openings 140*a* and 140*b* of the main body of the apparatus shown in FIG. 8, and the staple stacker 200 is inserted toward the direction of the arrow Y which is the attaching direction to the main body of the apparatus.

Although the staple stacker 200 has been described as an example of the post-processing device attached selectively to the image forming apparatus, it is also possible that the post-processing device is a mail bin sorter having a plurality of bins or a puncher having a punching function.

Even if the post-processing device is attached, similarly to the case in which the ejection tray 40 is attached, since the sheet ejection unit is retreated by the width L toward the inside of the main body from the sheet supply unit, the staple stacker 200 can overlap with the main body of the image forming apparatus by the retreated length L. Therefore, the width of the apparatus can be decreased. When the post-processing device becomes larger, this configuration is more effective in miniaturizing the apparatus.

As described above, the connecting configuration between the standard ejection tray 40 and the main body of the image forming apparatus 1 and the connecting configuration between the post-processing device and the main body of the image forming apparatus 1 are substantially unified, so that the post-processing device can be easily attached to the single image forming apparatus. Further, with reference to the attachment and detachment operations, the same operation sense can be held.

Since the load of the drawable post-processing device 200 is supported by the frame portions having the sufficient strength, even if the post-processing device has the heavy weight, the position which receives the load becomes optimum and the sufficient strength is obtained.

The lower rollers 81*a* and 81*b* and the upper rollers 82*a* and 82*b*, which serve as supporting means for slidably supporting the ejection tray 40 with respect to the main body of the image forming apparatus 1, support the post-processing device when the post-processing device is attached to the main body of the image forming apparatus 1. Since the common supporting means supports the ejection tray and the post-processing device which are selectively attached to the main body of the image forming apparatus 1, it is not necessary that the individual supporting means for supporting each of the ejection tray and the post-processing device is provided in the main body of the image forming apparatus. Therefore, cost can be suppressed.

The configuration, in which the rod-shaped rails are provided in the ejection tray 40 or the staple stacker 200 which is attached to or detached from the main body of the apparatus and the rollers are provided on the main body side of the apparatus, has been shown as an example of the configuration which slidably supports the ejection tray or the staple stacker 200 in the above-described embodiment. However, it is also possible that the guide rails are provided in the rod-shaped guide rails provided in the ejection tray 40 or the staple stacker 200 and a support plate which slidably supports the ejection tray 40 or the staple stacker 200 by guiding the guide rollers is provided on the main body side of the apparatus. It is also possible that the rollers are not used, the support plates are provided in each of the ejection tray 40 or the staple stacker 200 and the main body of the apparatus, and the ejection tray 40 or the staple stacker 200 is slidably supported by the support plate on the main body side of the apparatus.

It is also possible that a slidably moving member is provided in the main body of the apparatus and the ejection tray or the post-processing device is attached to the moving member. The moving member and the ejection tray or the post-processing device can be connected, for example, in such a manner that a hook provided in the ejection tray or the post-processing device is hooked on a pin provided in the moving member. In this case, it is possible that the connecting configuration between the ejection tray and the main body of the apparatus is equal to the connecting configuration between the post-processing device and the main body of the apparatus.

[Jam Disposal of Double-sided Conveying Path]

In addition to the jam disposal of the second sheet conveying path serving as the sheet path to the sheet ejection unit, the configuration which performs the jam disposal of the double-sided conveying path 71 will be described below referring to FIG. 11. The double-sided conveying path 71 is one in which the sheet is fed to the image forming unit again in order to form the image on the backside of the sheet in which the image formation on the first surface has been finished. The double-sided conveying path 71 is arranged in a double-sided conveying unit 301 which is slidably provided with respect to the main body of the image forming apparatus 1. When the sheet S is jammed in the double-sided conveying path 71 or the conveying path near the double-sided conveying path 71, the jam disposal is performed by drawing the double-sided conveying unit 301 which includes the double-sided conveying path 71, the pair of double-sided first conveying rollers 72, the pair of double-sided second conveying rollers 74, and the double-sided conveying sensor 73.

Figure 11:
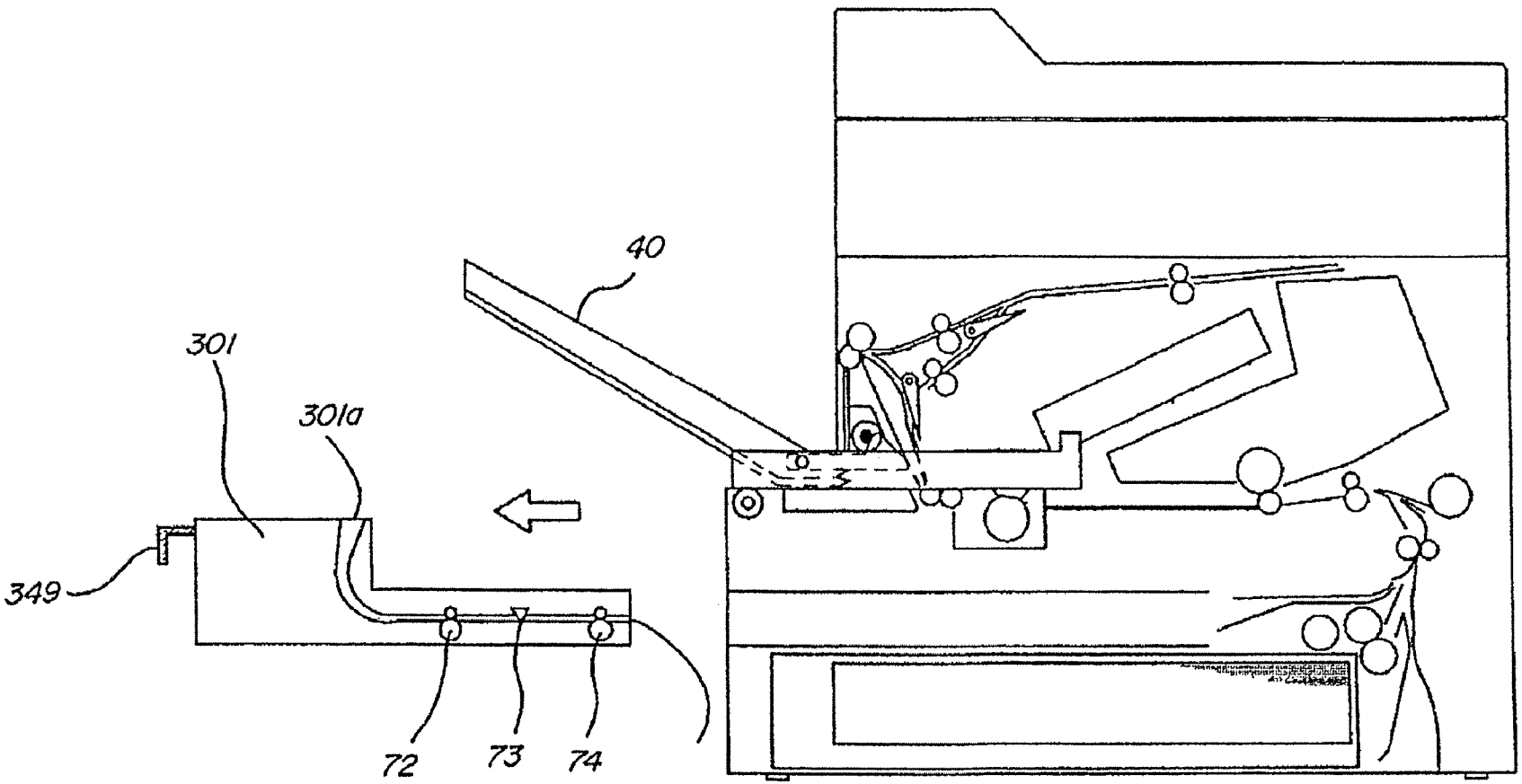
FIG. 11 is an explanatory view of the state in which a double-sided feed unit is drawn out.

FIG. 11 is an explanatory view of a state in which the double-sided conveying unit has been drawn out.

The double-sided conveying unit 301 has a guide member (not shown) which is horizontally slidable in the image forming apparatus. As shown in FIG. 11, the double-sided conveying unit 301 is configured so as to be slidable in the same direction as the slide direction of the ejection tray 40.

In the jam disposal, as shown in FIG. 11, the user can put user's hand on a handle 349 provided at the end portion of the double-sided conveying unit 301 to draw the double-sided feed unit 301 toward the left side (arrow direction).

In the drawing operation, the double-sided conveying unit 301 can be perfectly detached from the main body of the image forming apparatus, and the jammed sheet can be removed from a sheet path 301*a* on the upper portion of the double-sided conveying unit 301 or a sheet path 301*b* on the right side.

After the jam disposal is finished, the double-sided conveying unit 301 can be attached by inserting the double-sided conveying unit 301 into the image forming apparatus.

According to the configuration, in the jam disposal, it is possible that the slide direction of the ejection tray 40 and the post-processing device is equal to the slide direction of the double-sided conveying unit 301. Therefore, the operability can be unified, and the user can easily perform the jam disposal.

In the embodiments, the image forming apparatus in which the sheet is fed to the image forming unit to form the image and the sheet is ejected to the sheet ejection unit after the image formation has been described as an example of the image processing apparatus. However, the invention can be also preferably applied to not only the image forming apparatus such as the printer and the copying machine but also the image reading apparatus such as the scanner.

Namely, in the image reading apparatus having an image reading unit as the image processing unit, the sheet feed configuration and the sheet ejection configuration which have been shown in the above-described embodiments can be used for the apparatus in which the sheet document is fed from the sheet supply unit to the image reading unit and the document is ejected to the sheet ejection unit after the reading.

As described above, since the sheet conveying path is opened and closed in conjunction with the slide movement of the ejection tray or the post-processing device in the invention, in opening the sheet conveying path, there is no fear that the sheet ejected to the ejection tray falls down from the ejection tray, and the user can easily perform the jam disposal or the like.

What is claimed is:

1. An image processing apparatus comprising:

an apparatus main body;

an image processing unit, which performs image processing to a sheet, provided in the apparatus main body;

a discharging portion where sheets are stacked after being image-processed by said image processing unit; and a guide member which forms a sheet conveyance route between said image processing unit and said discharging portion and is rotatably disposed in the apparatus main body, wherein said discharging portion is supported by the apparatus main body so as to slidably move;

the guide member rotates to open the sheet conveyance route when the discharging portion slides in an opening direction, and a contacting portion makes the guide member rotate to close the sheet conveyance route when the discharging portion slides in a closing direction;

a discharging tray or a post-processing device is alternatively chosen for the discharging portion; and a supporting mechanism for sliding movement is common for both the discharge tray and the post-processing device and both the discharge tray and the post-processing device move the contacting portion for rotating the guide member.

2. An image processing apparatus according to claim 1, wherein the supporting mechanism for the discharge tray and the post-processing device supports rails included in the discharge tray and the post-processing device, and wherein the supporting mechanism includes upper rollers abutting on an upper side of the rails and lower rollers abutting on a lower side of the rails, and the upper rollers are provided on a downstream side of the lower rollers in an attachment direction of the post-processing device.

3. An image processing apparatus according to claim 1, wherein the sheet path has a first path which reverses a surface of the sheet after image processing to guide the sheet to the discharging portion and a second path which guides the sheet after image processing to the post-processing device, and the second path is opened and closed in conjunction with the slide movement of the discharging portion with respect to the apparatus main body.

4. An image processing apparatus according to claim 1, further comprising an abutting portion provided on the post-processing device configured to abut on the sheet guide member, wherein the sheet path is opened by moving the sheet guide member in conjunction with the slide movement of the post-processing device in the direction in which the post-processing device are separated from the apparatus main body, and the sheet path is closed by moving the sheet guide member in conjunction with the slide movement of the post-processing device in the direction in which the post-processing device are attached to the apparatus main body.

5. An image processing apparatus according to claim 1, wherein a pivot of the guide member is rotatably arranged for opening the sheet conveyance route by its own weight, and the contacting portion presses the guide member to regulate the rotation by its own weight and the guide member rotates to open the sheet conveyance route when the contacting portion slides to be apart from a pressing position to the guide member.

6. An image processing apparatus according to claim 1, wherein the contacting portion of the discharge tray and the contacting portion of the post-processing device has the same configuration.

* * * * *